US005873010A

United States Patent [19]

Enomoto et al.

[11] Patent Number: 5,873,010

[45] Date of Patent: Feb. 16, 1999

[54] IMAGE FORMING APPARATUS FOR PERFORMING CORRECTION CONTROL, BASED ON DENSITY OF TONER IMAGE

[75] Inventors: Naoki Enomoto, Yokohama; Takao Aoki, Abiko; Haruo Fujii; Hiroshi Sasame, both of Yokohama; Tatsuhiko Hayakawa, Tokyo; Tatsuya Kobayashi, Soka; Tetsuya Kobayashi, Kawasaki; Akihiko Uchiyama, Yokohama; Yoshiro Saito, Yokohama; Yoichiro Maebashi, Yokohama, all of Japan

[73] Assignee: Canon Kabushiki Kaisha, Tokyo, Japan

[21] Appl. No.: 310,070

[22] Filed: Sep. 22, 1994

[30] Foreign Application Priority Data

Sep. 28, 1993 [JP] Japan ..... 5-263028

[51] Int. Cl.[6] ..... G03G 15/01

[52] U.S. Cl. ..... 399/39

[58] Field of Search ..... 355/326 R, 327, 355/246, 245, 208; 399/39–41

[56] References Cited

U.S. PATENT DOCUMENTS

| | | | |
|---|---|---|---|
| 4,789,878 | 12/1988 | Endo et al. . | |
| 4,814,834 | 3/1989 | Endo et al. . | |
| 4,958,192 | 9/1990 | Kusumoto | 355/245 |
| 4,989,043 | 1/1991 | Suzuki et al. | 355/246 |
| 5,206,783 | 4/1993 | Maeda et al. | 355/246 |
| 5,258,810 | 11/1993 | Bresina et al. | 355/208 |
| 5,343,282 | 8/1994 | Kazaki et al. | 355/326 R |

*Primary Examiner*—William J. Royer

*Attorney, Agent, or Firm*—Fitzpatrick, Cella, Harper & Scinto

[57] ABSTRACT

A color image forming apparatus having a plurality of developers is disclosed. The apparatus includes a photosensitive drum, a density sensor for detecting a developed control toner image, CPU and RAM. The apparatus performs a first control for image formation based on a density of a control toner image developed by a first developer, a second control for image formation based on a density of a control toner image developed by a second developer, and determining whether the second control is to be performed based on the density of the control toner image developed by the first developer.

8 Claims, 12 Drawing Sheets

(TEMPERATURE, HUMIDITY)

ΔD; DIFFERENCE BETWEEN TARGET DENSITY AND MEASURED DENSITY

ΔV; AMOUNT FOR WHICH VDC IS TO BE CORRECTED IN ORDER TO PERMIT TONER IMAGE DENSITY TO BE TARGET DENSITY

IMAGE FORMING APPARATUS FOR PERFORMING CORRECTION CONTROL, BASED ON DENSITY OF TONER IMAGE

BACKGROUND OF THE INVENTION

1. Field of the Invention

The present invention relates to an image forming apparatus such as an electrophotographic apparatus, an electrostatic recording apparatus, etc., and more particularly to a color image forming apparatus having a plurality of developers.

2. Description of the Related Art

FIG. 12 is a cross-sectional view of an example of a full-color image forming apparatus having a plurality of developers. In FIG. 12, a photosensitive drum 1, which is a latent image carrier, is provided approximately in the center of the main body of apparatus, a supporting member 7 supports a plurality of developers 4*a*, 4*b*, 4*c*, 4*d* on the right side with respect to the drum 1, and a transfer drum 5 is set on the left side with respect to the photosensitive drum 1. The transfer drum 5 performs functions of carrying a transfer sheet (not shown) and transferring an image on the photosensitive drum 1 onto the transfer sheet. In the upper region inside the apparatus body there is an exposure device consisting of a laser diode 11, a polygon mirror 13 rotatably driven by a high-speed motor 12, a lens 14, and a return mirror 15.

The photosensitive drum 1 is rotated in the direction of the arrow and uniformly charged by a charging means 2. An optical image through an optical path 16 is projected onto the photosensitive drum 1 to form an electrostatic latent image thereon. This latent image is developed into a visible image, i.e., into a toner image by any one of the developers (4*a*, 4*b*, 4*c*, 4*d*) accommodating color developing agents, for example, of yellow (Y), magenta (M), cyan (C), and black (Bk), respectively.

On the other hand, the transfer sheet is supplied from inside a transfer sheet cassette 17 onto the surface of the transfer drum 5 by a pickup roller 18 in synchronization with the image on the photosensitive drum 1. Keeping the supplied transfer sheet gripped by a gripper 19 and adhered to the transfer drum 5 by an adhering roller 20, the transfer sheet is guided to a position where it opposes the photosensitive drum 1. The toner image on the photosensitive drum 1 is transferred in a superimposed manner onto the transfer sheet wound around the transfer drum 5 with an electric field applied between the photosensitive drum 1 and the transfer drum 5.

Describing in further detail, for example, the developer 4*a* accommodating the yellow (Y) developing agent first visualizes a first electrostatic latent image formed on the photosensitive drum 1 by exposure based on a first color image signal, and thereafter the toner image is transferred onto the transfer sheet held on the transfer drum 5. Subsequently, residual toner on the photosensitive drum 1 is cleaned by a cleaning device 6 such as a fur brush, a blade means, etc. Then a second color electrostatic latent image is formed on the photosensitive drum 1 by exposure based on a second color image signal, for example, by the developer 4*b* having the magenta (M) developing agent. Thereafter, the toner image is transferred onto the transfer sheet on the transfer drum 5, and superimposed on the first color, yellow, a visible image having been transferred.

Next, repeating the same steps as above, a toner image of a third color, for example, of cyan (C) and a toner image of a fourth color, for example, of black (Bk), are successively transferred in a superimposed manner onto the transfer sheet on the transfer drum 5. After that, the transfer sheet is separated from the transfer drum 5 by a separating claw 8, and the resultant toner image is fused, mixed, and fixed by a fixing device 9 to obtain a full-color permanent image.

After separating the transfer sheet, the transfer drum 5 is cleaned by a transfer roller cleaning device 22 such as a fur brush, a web, etc. to remove toner deposited on the surface, and an eliminator roller 21 eliminates charge on the transfer drum 5 to electrically initialize the drum. The eliminator roller 21 is also used for eliminating charge given in transferring the toner image from the photosensitive drum 1 onto the transfer drum 5.

The above color image forming apparatus would fail to achieve correct color tone if the image density changed depending upon various conditions such as operating temperature-humidity environment, the number of prints, etc. Thus, the conventional apparatus is arranged so that a toner image for detection of density is formed on the photosensitive drum or on the transfer drum, the density of the image is detected by density detecting means, and the detection result is fed back to control the exposure amount, development bias, etc., thereby obtaining stable and excellent images.

However, the color image forming apparatus arranged to have the means for forming the toner image for detection of density on the photosensitive drum or on the transfer drum, for detecting the density thereof, and for feeding the detection result back to control the exposure amount, development bias, etc. has a drawback of increased print cost, because it is arranged to form detection-purpose toner images of respective colors of yellow, magenta, cyan, and black, which requires a lot of toner of respective colors, thus consuming a lot of toner for a purpose other than printing on the transfer sheet. Another drawback is a slowdown of printing speed, because time is consumed for producing a number of toner images and for detecting the density thereof. A further problem is an increase in the amount of waste toner after cleaning.

SUMMARY OF THE INVENTION

It is an object of the present invention to provide an image forming apparatus having decreased in usage of toner for detection of density.

It is another object of the present invention to provide an image forming apparatus wherein the time for correction control of image formation is descreased.

It is still another object of the present invention to provide an image forming method comprising a first step of performing a control associated with image formation, based on a density of a control toner image developed by a first developer; a second step of performing a control associated with image formation, based on a density of a control toner image developed by a second developer; and a third step of determining whether the second step is to be performed, based on the density of the control toner image developed by the first developer.

It is still another object of the present invention to provide an image forming apparatus comprising an image carrying member for carrying an electrostatic image; a plurality of developers for developing the electrostatic image on the image carrying member; control means for performing a correction control associated with image formation, based on a density of a control toner image developed; and determining means for determining whether a correction control with another developer is to be performed based on a density of a control toner image developed by a predetermined developer.

Further objects of the present invention will be apparent from the following description.

DESCRIPTION OF THE PREFERRED EMBODIMENTS

Embodiments of the present invention will be described referring to the accompanying drawings.

Figure 12:
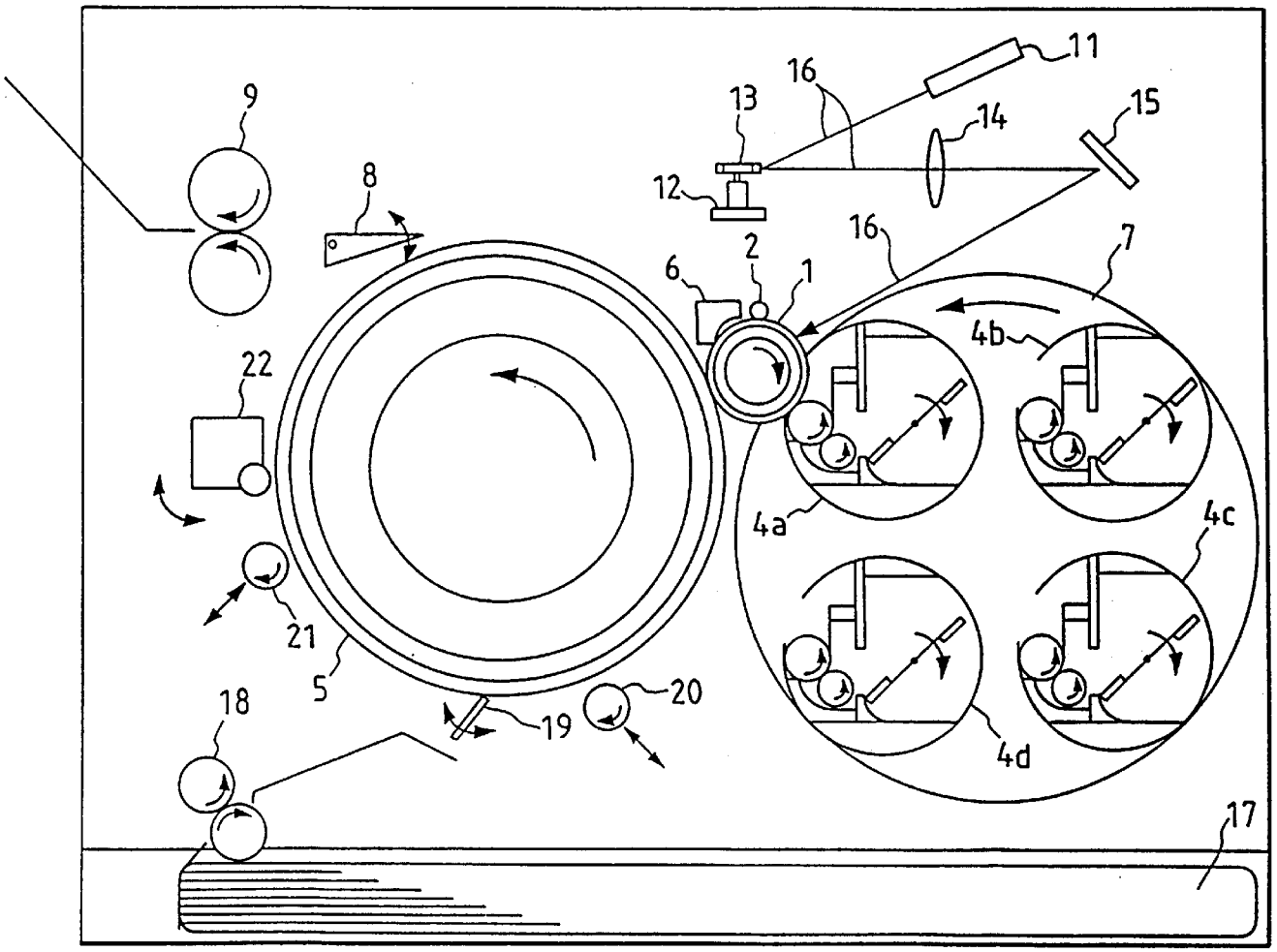
FIG. 12 is a drawing of an image forming apparatus.

The same members as those in the example shown in FIG. 12 will be denoted by the same reference numerals and their description will be omitted herein.

Embodiment 1

The first embodiment of the image forming apparatus according to the present invention will be described in detail with reference to FIG. 1 to FIG. 5.

Figure 1:
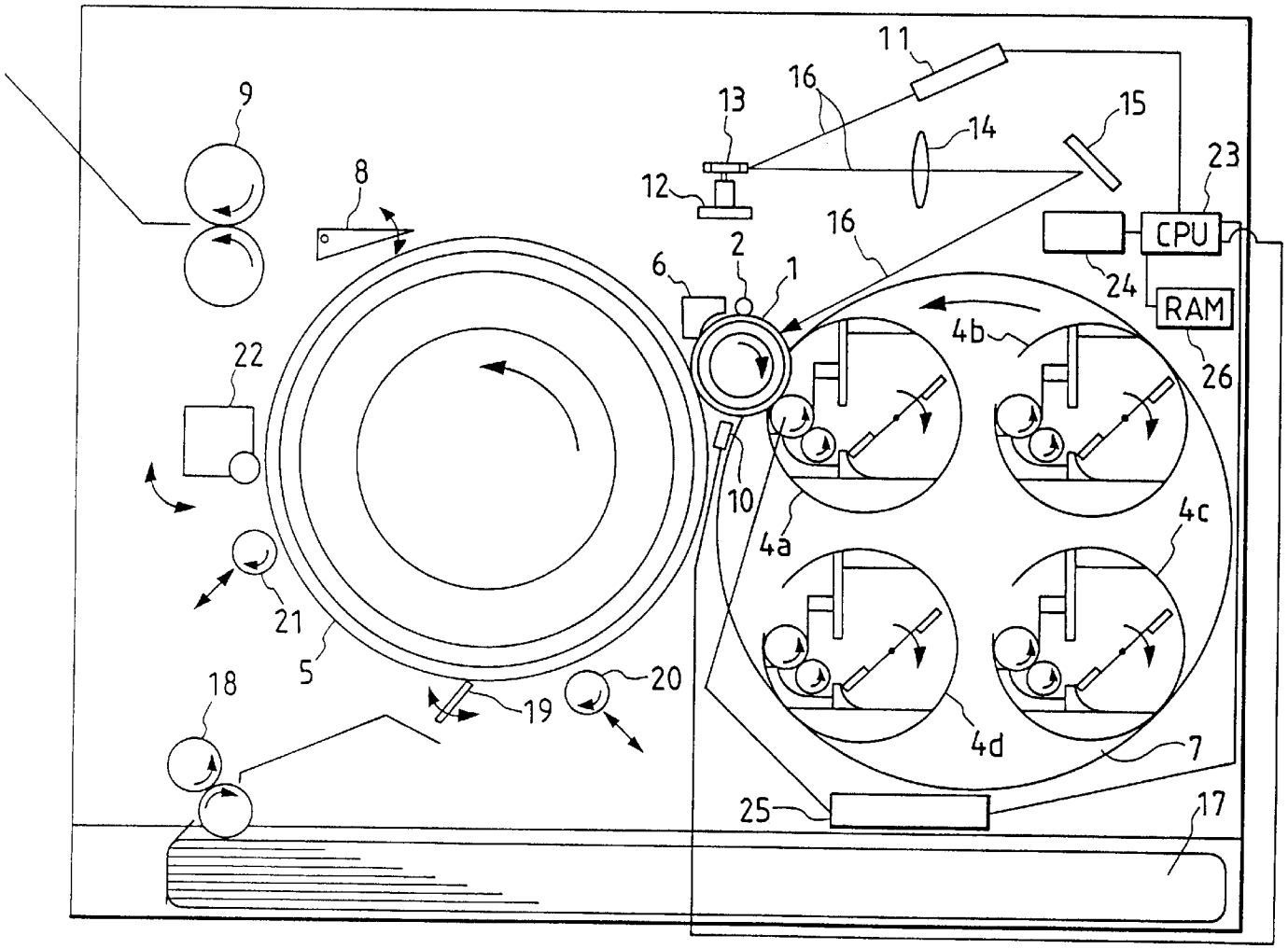
FIG. 1 is a drawing of the first embodiment of the image forming apparatus according to the present invention.

As shown in FIG. 1, a full-color image forming apparatus in the present embodiment is arranged so that a density sensor 10 is set in the vicinity of the photosensitive drum 1 as an image carrying member and is connected with a central processing unit CPU 23. Also connected with CPU 23 are a laser diode 11, a timer 24, and a RAM 26. Further, a bias source 25 is connected with a development sleeve for developers and with the CPU 23.

First density detection and density control is carried out during warmup or temperature control between start of power supply to the apparatus body and a time when a heating roller in a fixing device 9 reaches a predetermined fixing temperature.

Figure 2:
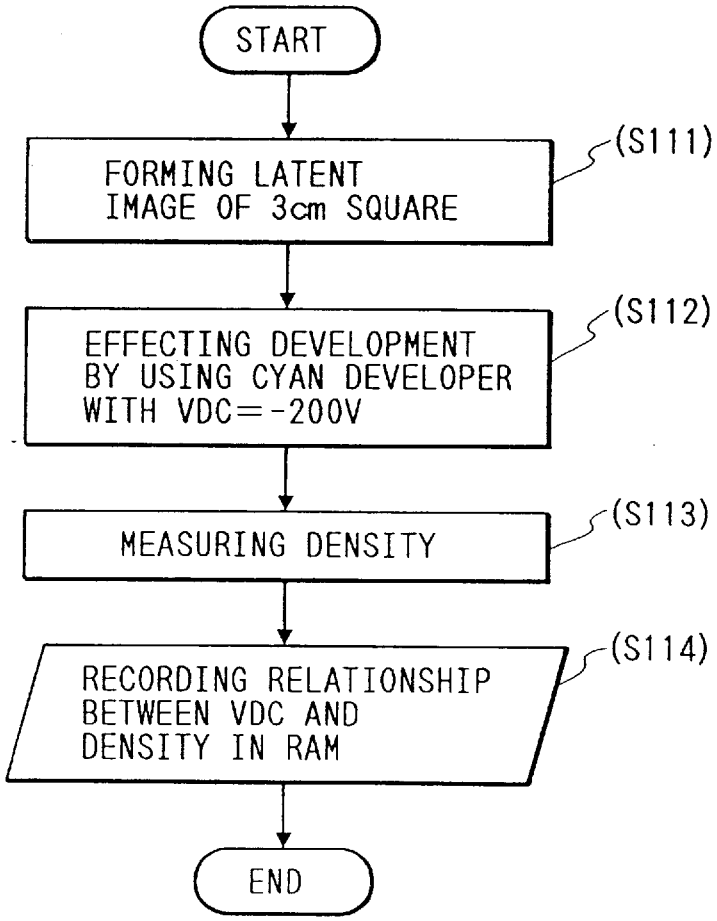
FIG. 2 is a flowchart of density measurement in the first embodiment.

This density detection and density control is carried out following the flowchart of FIG. 2 in the present embodiment. First, the density control is carried out for a first color, for example, for cyan.

The photosensitive drum 1 uniformly charged by a charging unit 2 is subjected to exposure by the laser diode 11, forming an electrostatic latent image for a density-detection-purpose toner image of a 3.0 cm square (surface potential: −100 V) (S111).

Next, this electrostatic latent image is developed by the cyan developer 4*a* having negatively charged cyan toner with a rectangular wave of frequency 1200 Hz, $V_{DC}$−200 V, and amplitude 1600 V (S112).

Then the density sensor 10 measures the density of the cyan toner image (S113). Further, the thus measured density of the toner image is recorded in RAM 26 (S114). The toner image after the measurement is cleaned by the cleaning device 6.

Similarly, changing $V_{DC}$ successively as to be −250 V, −300 V, −350 V, −400 V, or −450 V, a toner image for each $V_{DC}$ is developed and the density thereof is measured to be recorded in RAM 26.

Figure 3:
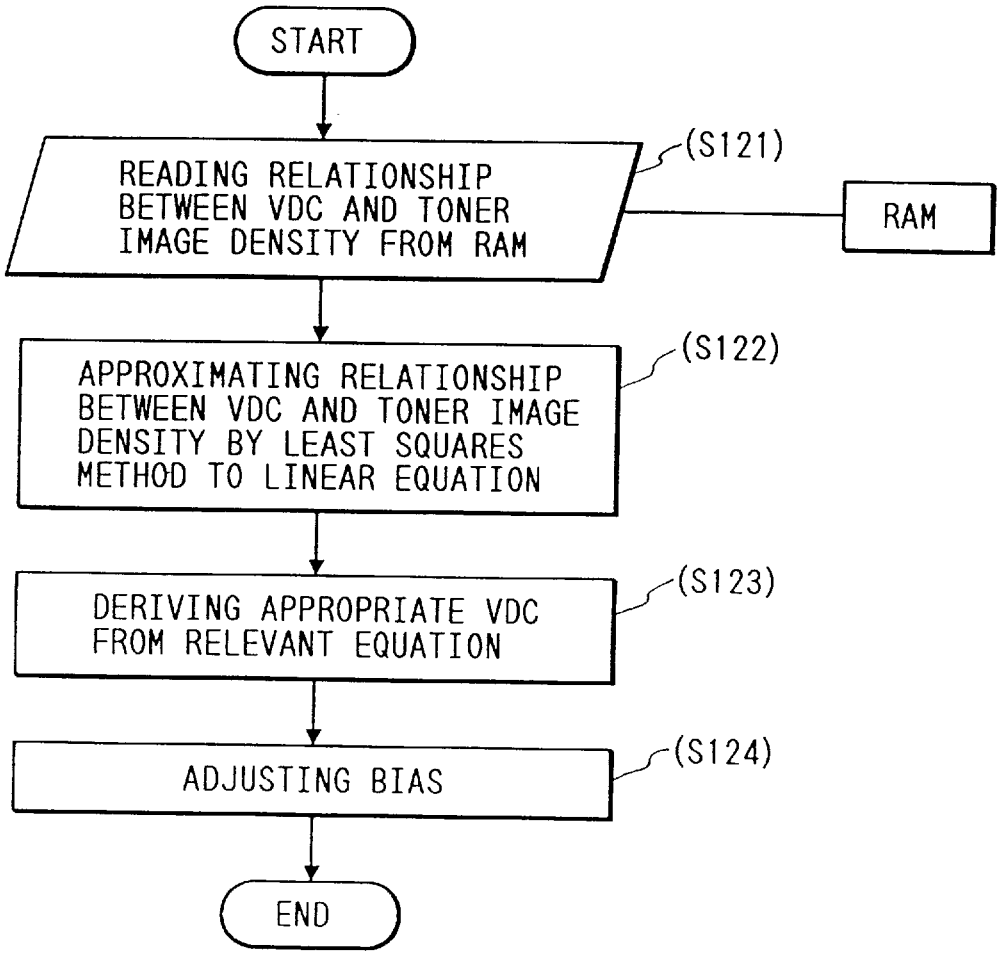
FIG. 3 is a flowchart to show steps for obtaining appropriate $V_{DC}$ in the first embodiment.

Then appropriate $V_{DC}$ is obtained from a relation between $V_{DC}$ and the toner image density. The flowchart of FIG. 3 shows steps for obtaining the appropriate $V_{DC}$.

Namely, the processing unit reads data of the relation between $V_{DC}$ and the toner image density recorded in RAM 26 (S121), approximates the relation between $V_{DC}$ and the toner image density to a linear equation by the method of least squares (S122), calculates an appropriate bias from the thus obtained linear equation (S123), and adjusts the bias (S124), completing the correction of cyan density.

Similarly, a toner image is formed for each of magenta, yellow, and black and the density correction is carried out for each toner image to adjust the bias source 25, completing the density correction.

Figure 4:
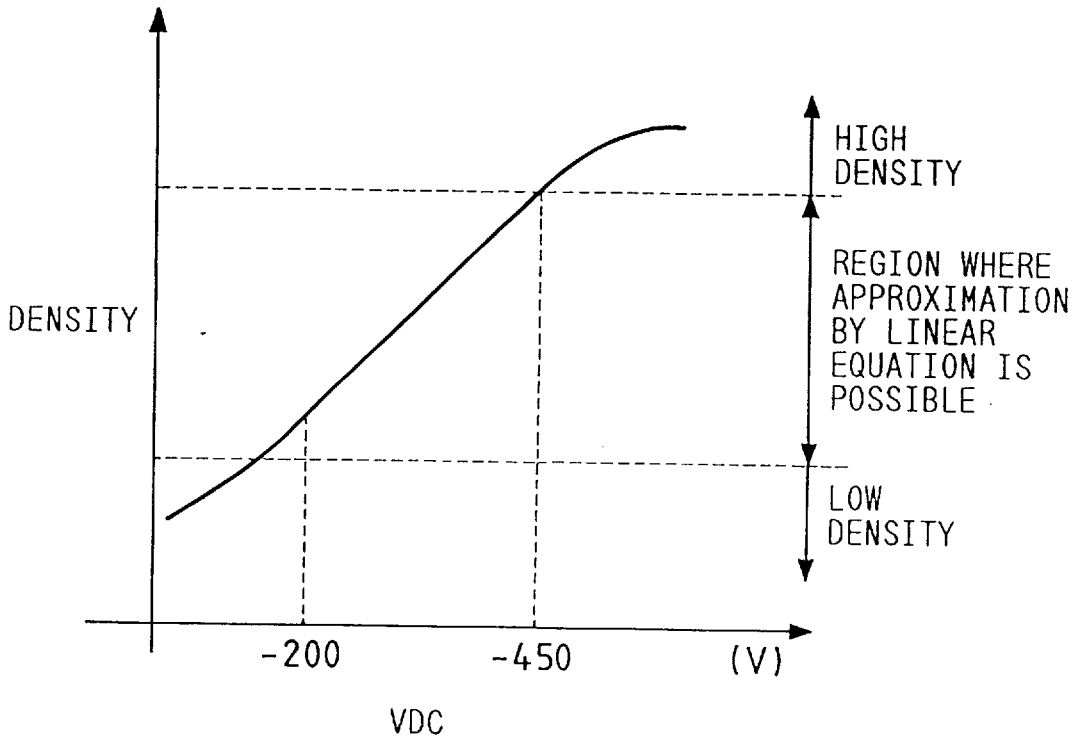
FIG. 4 is a graph to show a relationship between a change in $V_{DC}$ and the toner image density.

Incidentally, the density of toner image against a change in $V_{DC}$ changes as shown in FIG. 4. According to detailed experiments by the present inventors, it is possible that although the relation cannot be approximated by a linear equation on the high density side and on the low density side of toner image, it can be approximated by a linear equation in the range of $V_{DC}$ from −200 V to −450 V under an ordinary environment where the apparatus is operated.

Next, after passage of a predetermined time from the start of power supply as measured by the timer 24, the density is measured for a toner image developed by the cyan developer with the appropriate $V_{DC}$ for cyan obtained in the previous density detection. If the result of density measurement with, for example, a Macbeth densitometer (reflection density meter RD 914 manufactured by Macbeth Inc.) is, for example, within ±0.15 with respect to a target value, the density correction for cyan is not executed determining that there is no change in a state of density, thus getting ready for print. On the contrary, if there is a change in a state of density, the density detection and density correction is immediately carried out for all of the four colors.

Figure 5:
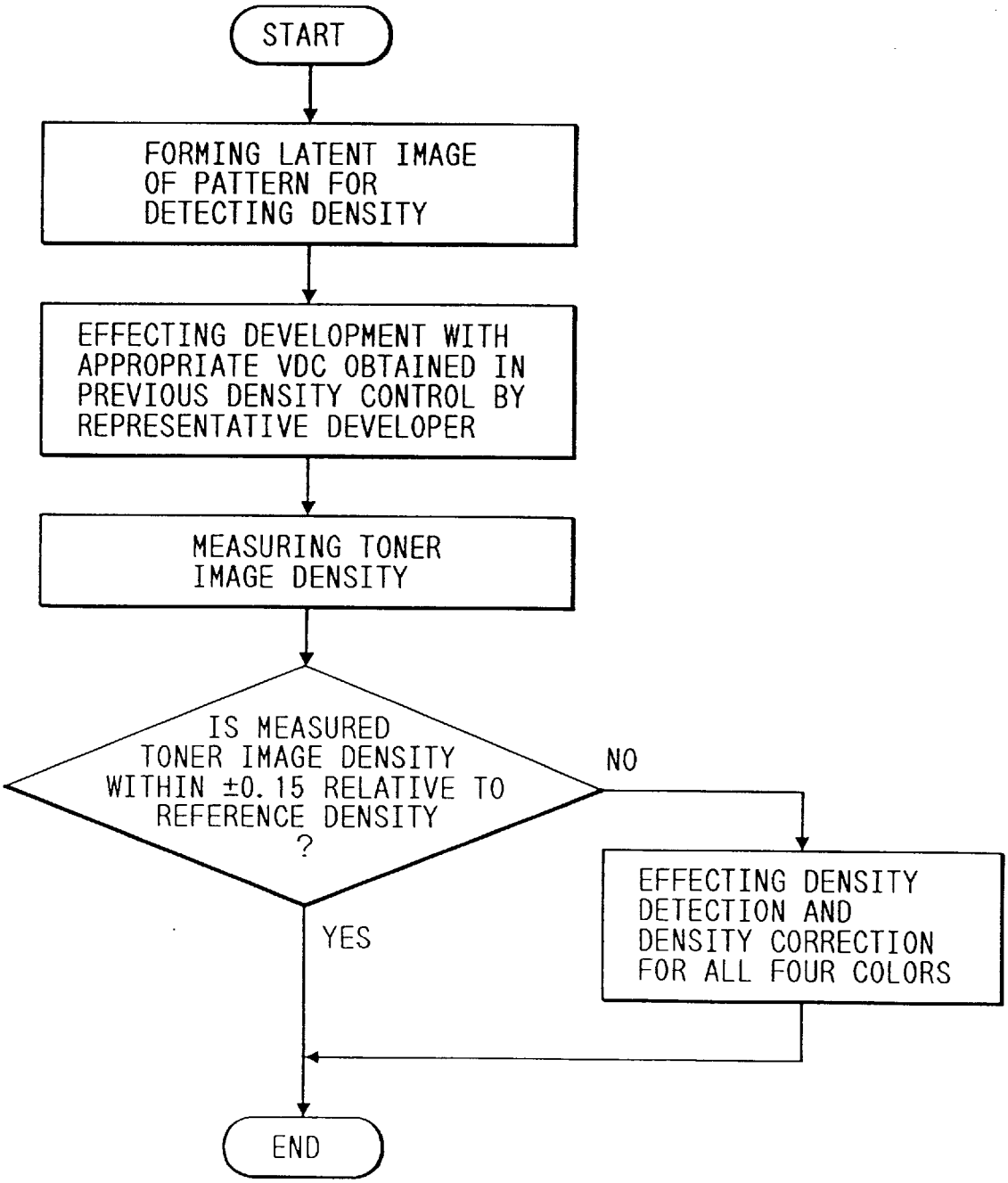
FIG. 5 is a flowchart of second or later density measurement and density correction in the first embodiment.

The second or later density detection and density correction is carried out following the flowchart of FIG. 5. First, a latent image of a pattern for detecting the density is formed on the photosensitive drum 1 and is developed by a representative developer with the appropriate $V_{DC}$ obtained in the previous density control. Then the density of the toner image is measured. It is judged whether the measured density of the toner image is within ±0.15 with reference to a reference density. If it is within ±0.15, then the density detection and density correction is not carried out; if it is not within the range, then the density detection and density correction is carried out for all of the four colors.

It should be noted that the same effect can also be achieved even if either one of magenta, yellow, and black is selected as the representative color for detection of the density after completion of the density control for the four colors.

It was verified that stable full-color images were obtained by selecting magenta or cyan as the representative color among the four colors. This is because magenta and cyan are visually prominent colors and have a significant effect on color balance of an image. With the representative color, either magenta or cyan, the density is monitored at a predetermined timing, for example performing the density detection every two hours after the density detection and density correction for the four colors, whereby images with stable color balance can be attained with minimum toner consumption. Black needs less stability than magenta or cyan, because, though being a visually prominent color, it is used for shadows in a natural image or for characters and lines in a full-color image.

Nonuniform consumption of specific color toner can be prevented by alternately switching the developers every predetermined period of time to change the representative color.

Here, the predetermined timing for executing the density detection for all of the four color developers may be a time of reset after handling jamming.

Embodiment 2

Figure 7:
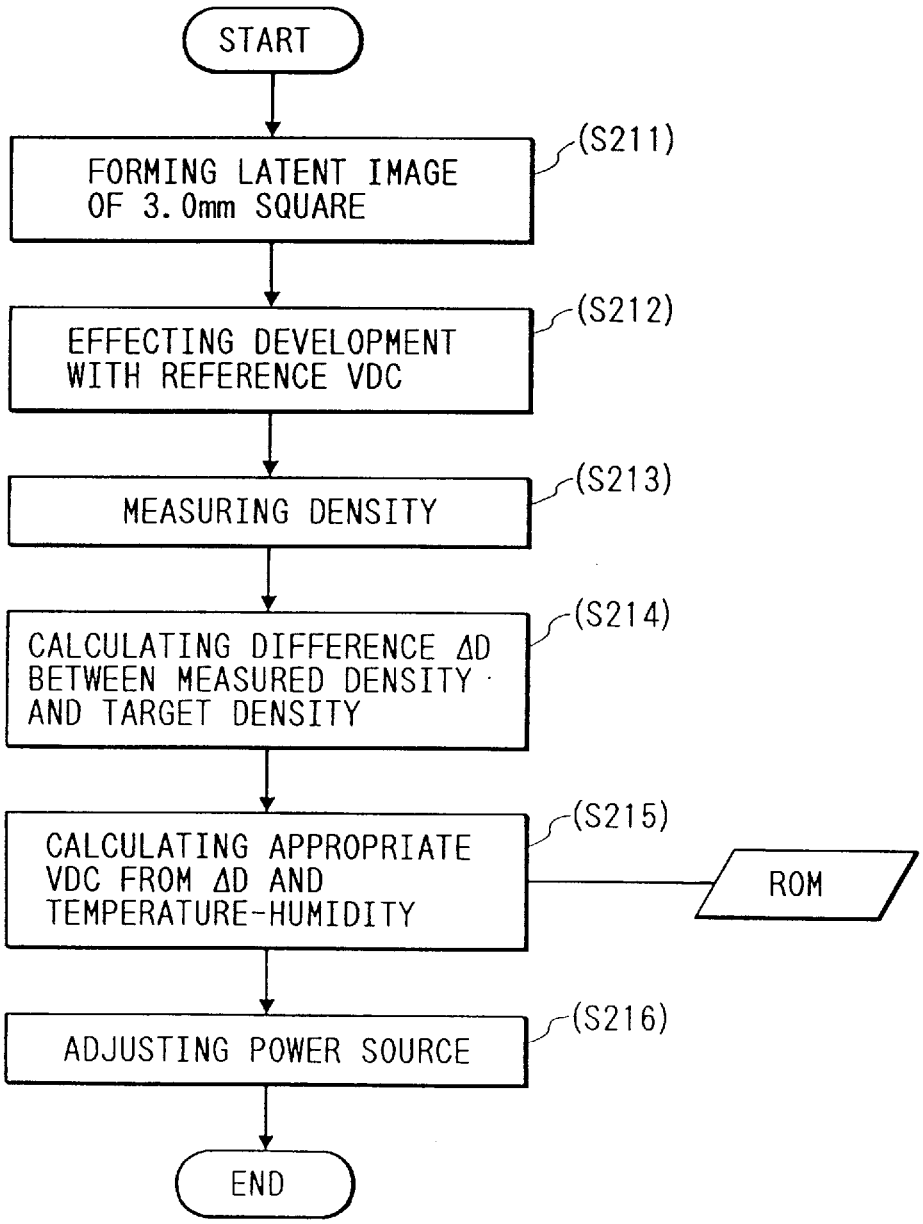
FIG. 7 is a flowchart of density measurement and density correction in the second embodiment.
Figure 8:
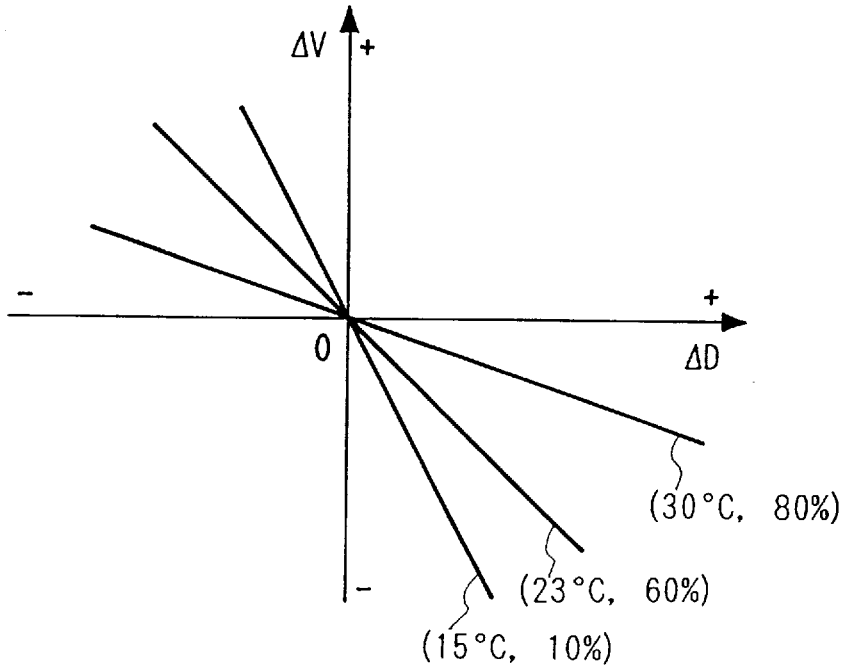
FIG. 8 is a graph to show a relationship between ΔD and ΔV.

The second embodiment of the image forming apparatus according to the present invention will be described referring to FIG. 6 to FIG. 8.

Figure 6:
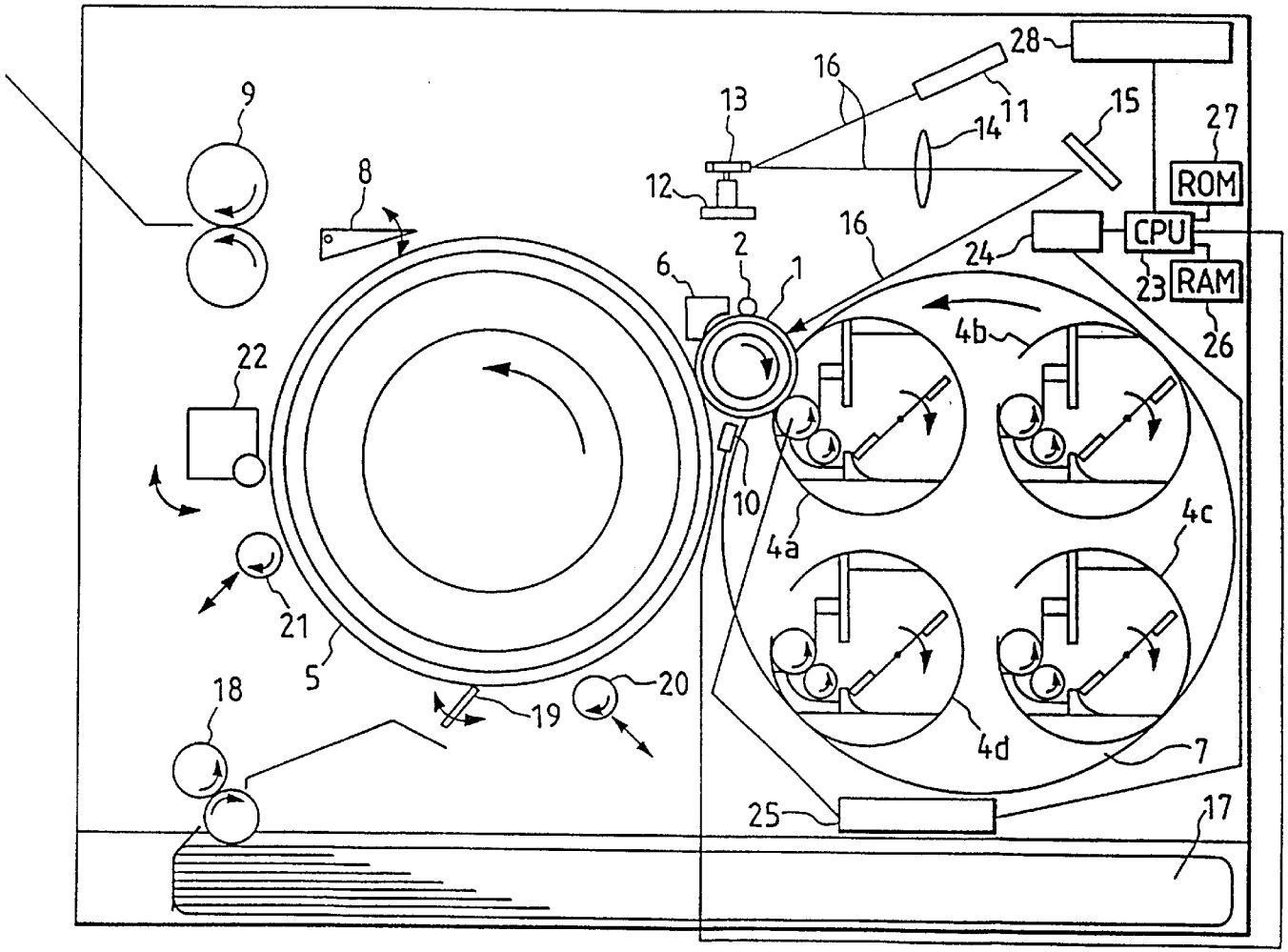
FIG. 6 is a drawing of the second embodiment of the image forming apparatus according to the present invention.

As shown in FIG. 6, the density sensor 10 is set in the vicinity of the photosensitive drum 1 and is connected with the central processing unit CPU 23. Also connected with the CPU 23 are a timer 24, a RAM 26, a ROM 27, and a temperature-humidity sensor 28. Further, the bias supply 25 is connected with the development sleeve for developers and with the CPU 23.

The density detection and density control is carried out after start of power supply to the apparatus body. The density detection and density control is carried out following the flowchart of FIG. 7 in the present embodiment.

First, the temperature-humidity sensor 28 measures the temperature and the humidity in the apparatus body. Then the density control is carried out for a first color, for example, for cyan.

Next, the photosensitive drum 1 uniformly charged by the charging unit 2 is subjected to exposure by the laser diode 11 to form an electrostatic latent image for a density-detection-purpose toner image of a 3.0 cm square (surface potential: −100 V) (S211). This electrostatic latent image is developed by the cyan developer 4*a* having negatively charged cyan toner with a rectangular wave of frequency 1200 Hz, $V_{DC}$−300 V (reference $V_{DC}$), and amplitude 1600 V (S212).

Then the density of the toner image is measured by the density sensor 10 (S213). The toner image after completion of the measurement is cleaned by the cleaning device 6. Then a difference ΔD is calculated between the measured density and a target density (S214).

Preliminarily recorded in ROM 27 is a relation between ΔD and a difference ΔV between $V_{DC}$ necessary to obtain the target toner density and the reference $V_{DC}$ in accordance with changes in temperature and humidity. FIG. 8 shows an example of the relation between ΔV and ΔD changing with changes in environment in the apparatus.

The CPU 23 calculates appropriate $V_{DC}$, based on the temperature and the humidity in the apparatus and on the data recorded in the ROM 27 (S215), and adjusts the bias source 25 (S216).

Similarly, the appropriate $V_{DC}$ is also calculated for each of the second color of magenta, the third color of yellow, and the fourth color of black, and the density correction is carried out by adjusting the bias source 26.

The present embodiment is so arranged, similarly as the first embodiment, that the timer 24 counts an elapsed time from the start of power supply, that after passage of a predetermined time the density is measured for a toner image developed by the cyan developer with the appropriate $V_{DC}$ for cyan obtained in the previous density detection, and that if the result of the density measurement with the Macbeth densitometer is, for example, within ±0.15 with respect to a target value, then the density detection for the other colors is not carried out under a determination that there is no change in the density state, thus getting ready for print. On the contrary, if a change in the density state is recognized, then the density detection and density correction is immediately carried out for all of the four colors.

Embodiment 3

Figure 9:
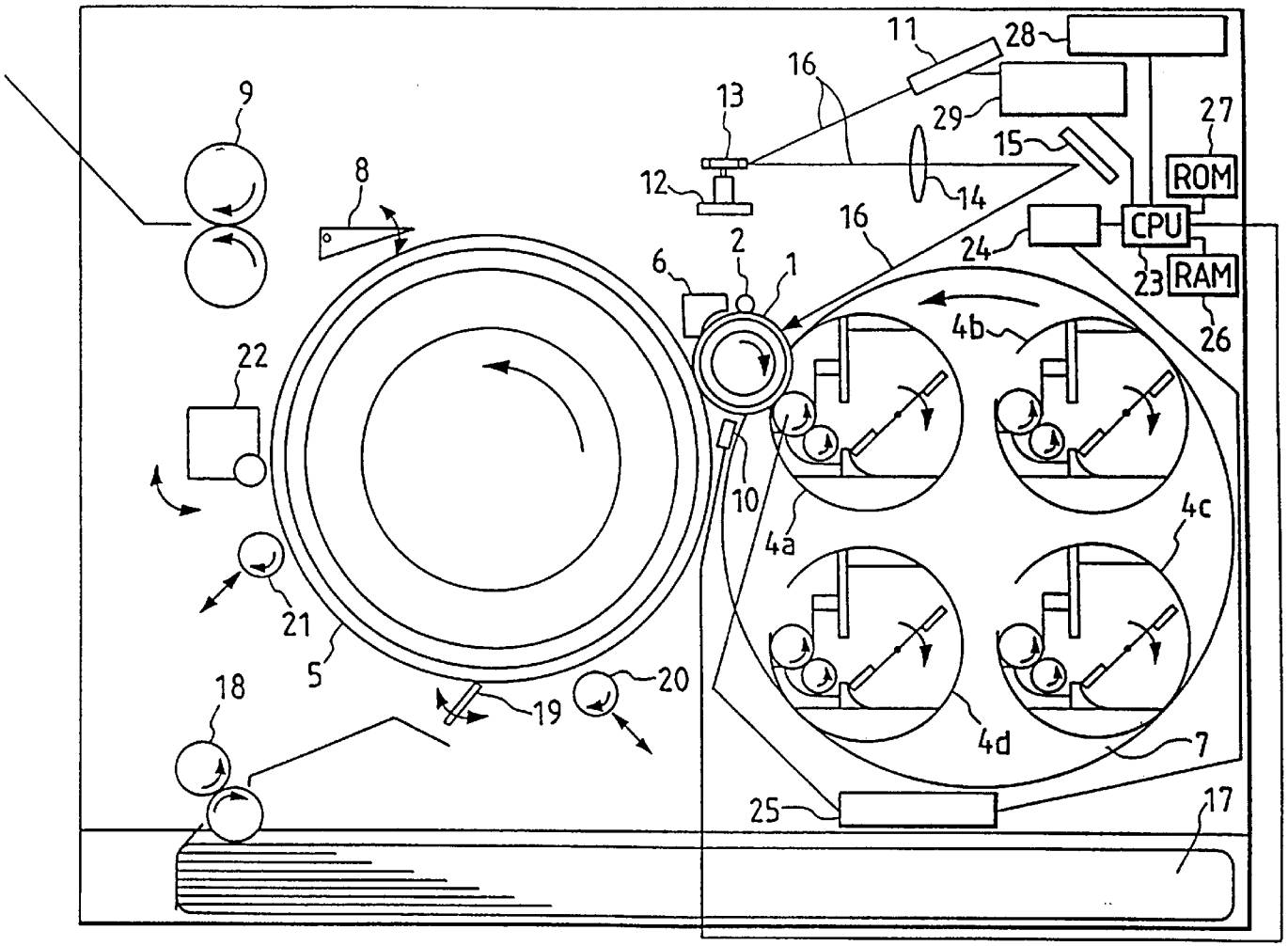
FIG. 9 is a drawing of the third embodiment of the image forming apparatus according to the present invention.
Figure 10:
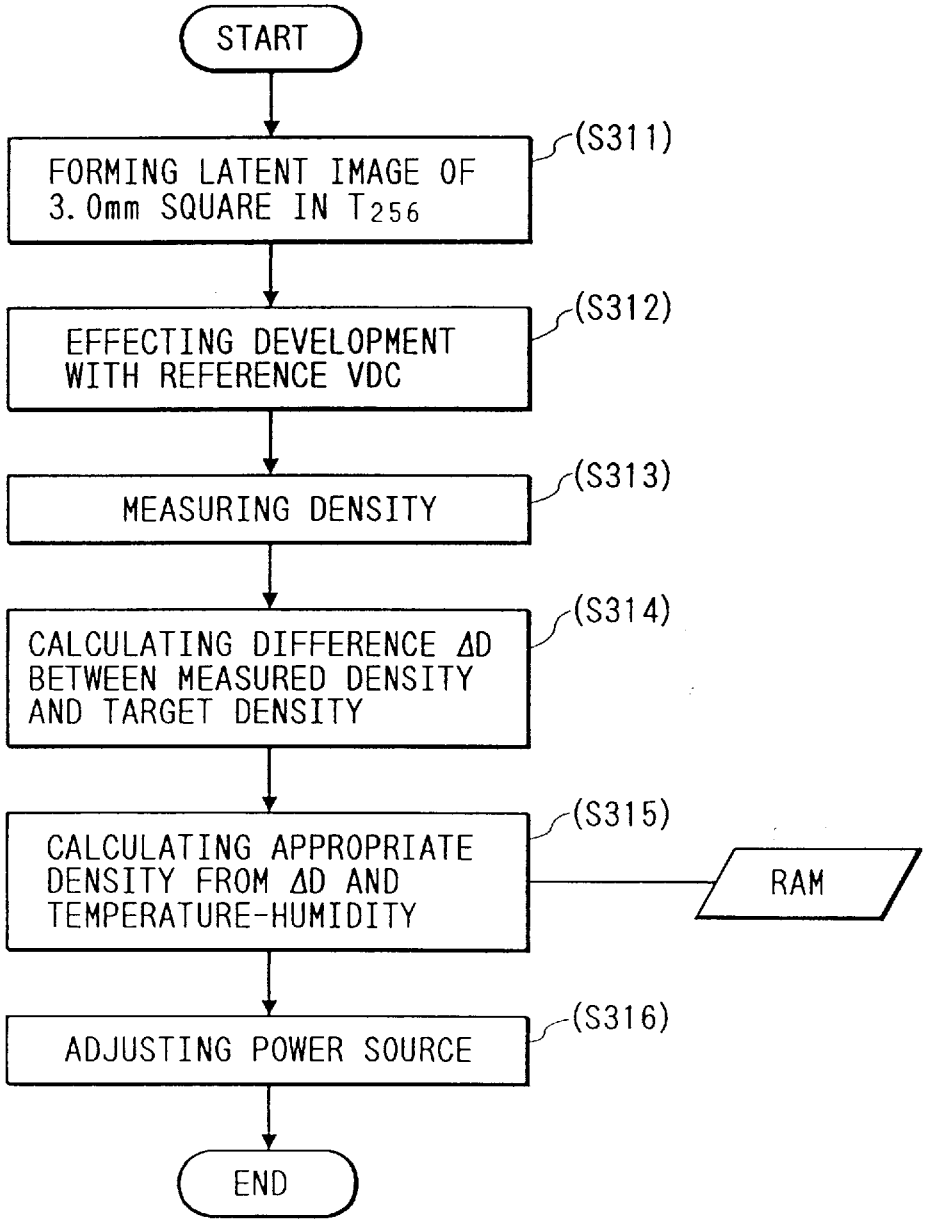
FIG. 10 is a flowchart of density measurement and density correction in the third embodiment.
Figure 11:
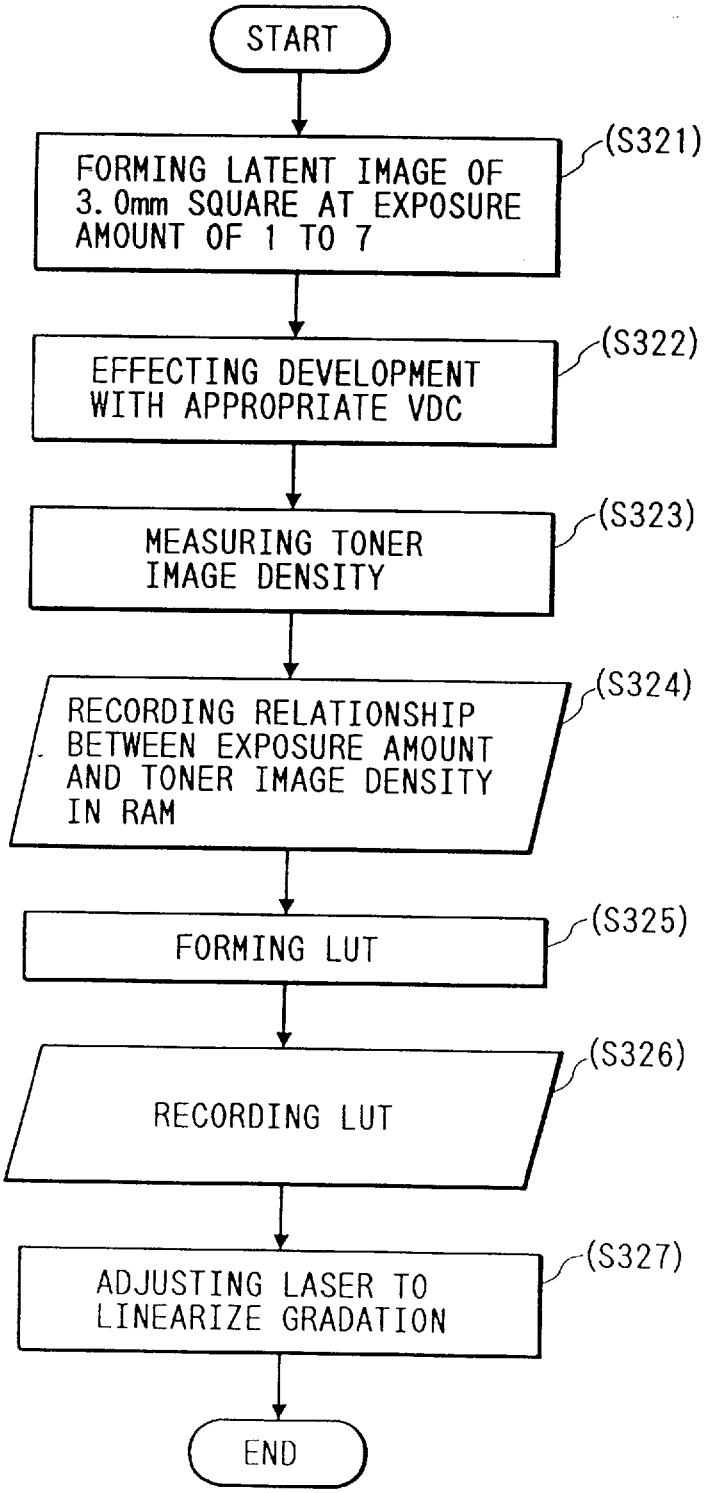
FIG. 11 is a flowchart to follow FIG. 10.

The third embodiment of the image forming apparatus according to the present invention will be described referring to FIG. 9 to FIG. 11.

The image forming apparatus of the present embodiment is arranged so that the duration of emission of the laser diode 11 is controlled by a pulse width modulating circuit 29 to enable the apparatus to express 256 gradations for each dot. Hereinafter, $T_a$ is defined as a/256 times a full lighting time for one dot.

The density detection and density control is carried out after start of power supply to the apparatus body. This density detection and density control is carried out following the flowchart of FIG. 10 in the present embodiment.

First, the temperature and the humidity in the apparatus body are measured by the temperature-humidity sensor 28. Then the density control is carried out for the first color, for example, for cyan.

Next, the photosensitive drum 1 uniformly charged by the charging unit 2 is subjected to exposure by the laser diode 11 for $T_{256}$ per dot to form an electrostatic latent image for a density-detection-purpose toner image of a 3.0 cm square (surface potential: −100 V) (S311). This electrostatic latent image is developed by the cyan developer 4*a* having negatively charged cyan toner with a rectangular wave of frequency 1200 Hz, $V_{DC}$−300 V (reference $V_{DC}$), and amplitude 1600 V (S312).

Then the density of the toner image is measured by the density sensor 10 (S313). The toner image after completion of the measurement is cleaned by the cleaning device 6. Next, the processing unit calculates the difference ΔD between the measured density and the target density (S314).

Here, preliminarily recorded in the ROM 27 is the relation between AΔand the difference ΔV between $V_{DC}$ necessary to obtain the target toner density and the reference voltage $V_{DC}$ in accordance with changes in temperature and humidity.

The CPU 23 calculates appropriate $V_{DC}$, based on the temperature and the humidity in the apparatus and on the data recorded in the ROM 27 (S315), and adjusts the bias source 25 (S316).

Next measured is a relation of the toner image density with the exposure time per dot. As shown in FIG. 11, exposure is performed for $T_{32}$ time (exposure time 1) per dot to form a latent image of a 3 cm square, and subsequently, 3 cm square latent images are successively formed with respective exposures for $T_{64}$ time (exposure time 2), for $T_{96}$ time (exposure time 3), for $T_{128}$ time (exposure time 4), for $T_{160}$ time (exposure time 5), for $T_{192}$ time (exposure time 6), and for $T_{224}$ time (exposure time 7) (S321).

Next, the latent images are developed with the appropriate $V_{DC}$ to form toner images for the above exposure amounts 1 to 7 (S322) and the density measurement is carried out for the toner images (S323). Then relations between the exposure amounts 1 to 7 and the densities are recorded in RAM 26 (S324).

Next, an LUT (look-up table) is produced from the relations between the exposure times and the densities (S325) and the LUT is recorded in the RAM 26 (S326). Then the laser diode 11 is adjusted so as to linearize the gradations (S327), thus completing the density correction.

Similarly, appropriate $V_{DC}$ is obtained for each of magenta, yellow, and black to produce LUTs from the relations between the exposure times and the densities and the laser diode 11 is adjusted so as to linearize the gradations.

The present embodiment is also so constructed, similarly as the previous embodiments, that the elapsed time from the start of power supply is measured by the timer 24, that after passage of a predetermined time the density is measured for the toner image obtained by developing the $T_{256}$ latent image by the cyan developer with appropriate $V_{DC}$ for cyan obtained in the previous density detection, and that if the result of density measurement with the Macbeth densitometer is within ±0.1 to ±0.2 with respect to a target value, then the density detection is not carried out for the other colors under a determination that there is no change in the density state, thereby getting ready for print. On the contrary, if a change in the density state is recognized, then the density detection and density correction is immediately carried out for all of the four colors.

Although the present invention was described with the above embodiments, it should be noted that the present invention is by no means limited to the above embodiments but may have various modifications within the technical concept of the invention.

What is claimed is:

1. A full color image forming method comprising:

a first step of performing an image formation control operation based on a density of a first control toner image developed by a first color developer;

a second step of performing an image formation control operation based on a density of a second control toner image developed by another color developer;

a third step of determining whether said second step is to be performed, based on the density of the first control toner image developed by the first color developer; and a fourth step of forming a full color image after said second step when it is determined that said second step should be performed in said third step or without performing said second step when it is determined that said second step should not be performed in said third step.

2. The method according to claim 1, wherein said first and second steps each comprise performing an image density control operation.

3. The method according to claim 1, wherein a color of toner in said first color developer is magenta or cyan.

4. The method according to claim 1, wherein in the third step a determination that the second step is to be performed is made when the density of the first control toner image developed by said first color developer is outside a predetermined range.

5. An image forming apparatus comprising:

an image carrying member for carrying an electrostatic image;

a plurality of developers for developing the electrostatic image on said image carrying member;

control means for performing a correction control operation associated with image formation, based on a density of a control toner image developed by a predetermined one of said plurality of developers before the image formation; and determining means for determining whether a correction control operation associated with another developer is to be performed, based on the density of the control toner image developed by said predetermined one of said plurality of developers, before the image formation and after the formation of the control toner image of the predetermined one of said plurality of developers.

6. The apparatus according to claim 5, wherein said control means performs correction of image density.

7. The apparatus according to claim 5, wherein said predetermined one of said plurality of developers accommodates magenta toner or cyan toner.

8. The apparatus according to claim 5, wherein said determining means determines that a correction control operation with another developer is to be performed when the density of the control toner image developed by said predetermined one of said plurality of developers is outside a predetermined range.

* * * * *

UNITED STATES PATENT AND TRADEMARK OFFICE

CERTIFICATE OF CORRECTION

PATENT NO. : 5,873,010

DATED : February 16, 1999

INVENTOR(S) : NAOKI ENOMOTO, ET AL.

It is certified that error appears in the above-identified patent and that said Letters Patent is hereby corrected as shown below:

Drawings:
SHEET 10,
Figure 10, "RAM" should read --ROM--.

COLUMN 2,
Line 44, "in" should be deleted; and
Line 48, "descreased." should read --decreased.--.

COLUMN 6,
Line 44, "AΔand" should read --ΔD and--.

COLUMN 8,
Line 27, Close up right margin.

Signed and Sealed this

Twenty-first Day of September, 1999

*Attest:*

Q. TODD DICKINSON

*Attesting Officer*

*Acting Commissioner of Patents and Trademarks*